US007845324B2

(12) United States Patent
Gecim et al.

(10) Patent No.: US 7,845,324 B2
(45) Date of Patent: Dec. 7, 2010

(54) SLIDING-PIVOT LOCKING MECHANISM FOR AN OVERHEAD CAM WITH MULTIPLE ROCKER ARMS

(75) Inventors: Burak A. Gecim, Rochester Hills, MI (US); John I. Manole, Chesterfield, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 361 days.

(21) Appl. No.: 12/014,950

(22) Filed: Jan. 16, 2008

(65) Prior Publication Data

US 2009/0178637 A1 Jul. 16, 2009

(51) Int. Cl.
*F01L 1/18* (2006.01)

(52) U.S. Cl. ..... 123/90.39; 123/90.16; 123/90.15

(58) Field of Classification Search ..... 123/90.16, 123/90.39, 90.44

See application file for complete search history.

(56) References Cited

U.S. PATENT DOCUMENTS 4,727,831 A 3/1988 Nagahiro et al.
4,777,914 A 10/1988 Konno
4,887,563 A * 12/1989 Ishida et al. ..... 123/90.16
5,280,770 A 1/1994 Satou et al.
2003/0029402 A1 2/2003 Pomerleau et al.

FOREIGN PATENT DOCUMENTS

JP 02-207134 A 8/1990

OTHER PUBLICATIONS

Kiyoshi Hatano, et al., Development of a New Multi-Mode Variable Valve Timing Engine, SAE Technical Paper, Mar. 1, 1993, Document No. 930878.

Kazuo Inoue, et al., A High Power, Wide Torque Range, Efficient Engine With a Newly Developed Variable-Valve-Lift and Timing Mechanism, SAE Paper, Feb. 1, 1989, Document Number 890675.

* cited by examiner

*Primary Examiner*—Zelalem Eshete
(74) *Attorney, Agent, or Firm*—Quinn Law Group, PLLC

(57) ABSTRACT

A locking mechanism for a plural rocker arm valve train assembly is provided. The locking mechanism is adapted for use with a camshaft having a plurality of different cam lobes having a plurality of different profiles, which result in variable valve displacement and duration. A plurality of rocker arms are located on a pivot shaft which runs parallel to the camshaft, each rocker arm having structures configured to be acted upon by respective lobes of the camshaft. An active rocker arm has structure configured to act upon an engine valve or valves. A movable locking element is fully enclosed by the rocker arms and is capable of selectively moving along the pivot shaft to allow the active rocker arm to selectively engage one or more of the other rocker arms for common pivoting, resulting in varied displacement of the engine valve or valves.

19 Claims, 4 Drawing Sheets

SLIDING-PIVOT LOCKING MECHANISM FOR AN OVERHEAD CAM WITH MULTIPLE ROCKER ARMS

TECHNICAL FIELD

This invention relates to a variable valve train for an internal combustion engine having two or more cam lobes per cylinder.

BACKGROUND OF THE INVENTION

The valve train is the mechanical system responsible for operation of gas exchange valves in internal combustion engines. These valves are driven, either directly or indirectly, by cam lobes on a camshaft. The timing of the valve opening and closing is important to vehicle performance, as it affects torque and power output of the engine as well as emissions. Different engine speeds require different valve timing and lift for optimum performance. Generally, low engine speeds require valves to open a relatively small amount over a shorter duration, while high engine speeds and loads require valves to open a relatively larger amount over a longer duration for optimum performance. Engines without some method of variable valve timing must compromise between optimization at either low or high speed and sacrifice some performance in the non-elected range. By adding the ability to choose between different cam profiles, and thus driving the valves differently at different speeds and loads, engines are able to better optimize performance throughout a wider range of engine operating conditions.

SUMMARY OF THE INVENTION

A locking mechanism for a plural rocker arm valve train assembly is adapted for use with a camshaft having a plurality of different cam lobe profiles. The plurality of rocker arms and the locking mechanism are supported by a pivot shaft that is parallel to the camshaft and that defines a common axis about which the rocker arms are rotatable. Each of the rocker arms is directly or indirectly acted upon by a corresponding cam lobe; each cam lobe has a different profile configured for varying valve lift and timing according to specific engine needs. One of the rocker arms is an active rocker arm which directly or indirectly operates at least one engine valve. A mechanism for selectively locking one or more secondary rocker arms to the active rocker arm is contained within the rocker housing, and operable to slide axially along the common axis.

The locking mechanism operates via a male element housed within a female cavity within the rocker arms. When hydraulic pressure is changed in response to changing engine conditions, the male elements slide between predetermined positions within the female cavities. This axial change of position causes the male elements to selectively lock or unlock the active rocker arm to an adjoining secondary arm so that the two move together as a unit or move independently of one another. Selectively locking the active rocker arm to a secondary rocker arm results in changing the cam profile which is controlling valve operation. Hydraulic fluid to actuate the system is supplied via parallel, axial galleries within the pivot shaft.

Placement of axially-sliding locking elements inside the rocker arms and around the pivot shaft enables a compact and lighter-weight rocker design. It also avoids the need for carrying pins, springs, machined holes, and oil-feed galleries located on the outer structures of the rocker arms, which can add mass and complexity to the rocker arms and actuation mechanism. Additional benefits include a system that is compact and imparts low torque on the locking mechanism.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
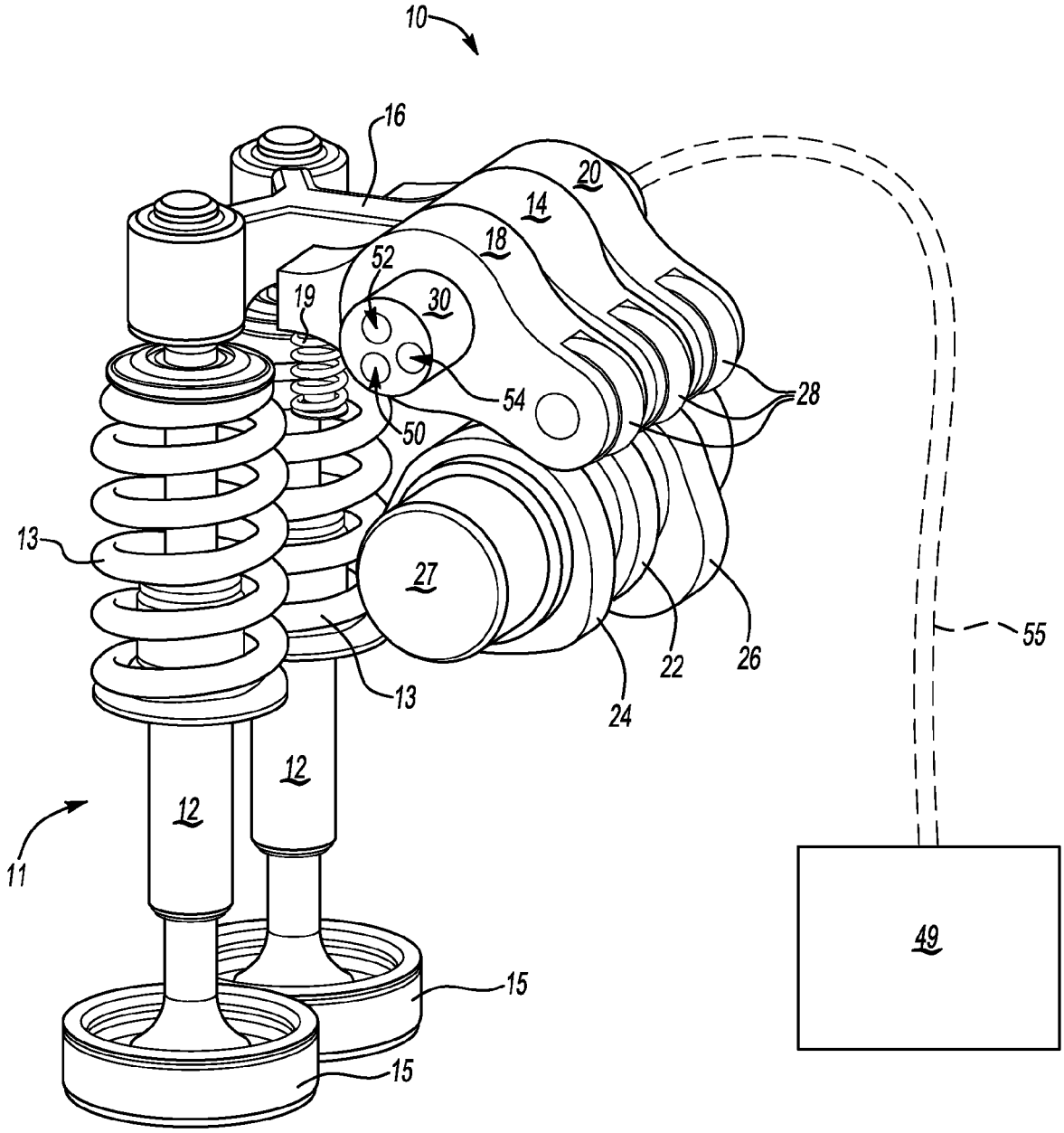
FIG. 1 is a perspective view of a plural rocker arm valve train assembly.

Referring to the drawings, wherein like reference numbers correspond to like or similar components throughout the several figures, there is shown in FIG. 1 a sliding-pivot locking mechanism employed in a valve train 10; which is a center-pivoted configuration driving two engine valves 11, with valve stems 12, valve springs 13, and valve seats 15. An active rocker 14, with a T-shaped valve-end 16, pushes on the two valves 11 of the same cylinder (not shown). The valve train could be alternately designed where the active arm actuates one engine valve, as will be recognized by those skilled in the art. In either one or two-valve embodiments, lash compensation is performed by hydraulic lash adjusters (not shown) placed at the valve-end 16 of the active rocker 14. Oil feed to the lash adjusters is communicated through a transfer passage (not shown in FIG. 1, shown as reference 56 of FIG. 3) inside the active rocker 14.

Straddling the active rocker 14 are two secondary rockers 18 and 20, which follow higher-lift cam lobes. In the embodiment of FIG. 1, in the order of increasing lift, the three lobes are indicated by: cam 22, cam 24, and cam 26, located on camshaft 27. Rollers 28 located at the cam-end of each rocker 14, 18, and 20 provide low-friction contact between the rockers 14, 18, and 20, and their respective cams 22, 24, and 26. All three rockers 14, 18, and 20 are pivotable around a stationary pivot shaft 30, which acts as a journal bearing support for the rockers. Those skilled in the art will recognize that this embodiment is a three step valve train having three different cam lobe profiles, and therefore three different valve displacements, from which to choose. Those skilled in the art will further recognize other valve train configurations within the scope of the claimed invention.

In operation, if neither of the secondary rocker arms 18 and 20 is locked to the active arm 14, then the engine valves 11 follow the input motion from cam 22, which is the lowest lift among the three lobes 22, 24, and 26. Inactive secondary arms 18 and 20 idle against their respective biasing springs 19 and 21 (not shown in FIG. 1, shown in FIG. 3) while riding along the lobes of cams 24 and 26, respectively.

If one of the secondary arms is locked to the active arm, the active and locked secondary arm pivot commonly and the valves 11 follow input from the higher of the two respective cam lobes, while the remaining (unlocked) secondary rocker arm idles against its biasing spring. For example, if the secondary arm 18 is locked to the active arm 14, the active arm 14 and secondary arm 18 pivot commonly and the valve follows input from cam 24—because that is the higher of cams 22 and 24—while the secondary rocker arm 20 idles against its biasing spring 21 (not shown in FIG. 1, shown in FIG. 3) as it follows cam 26. If desired, both secondary arms 18 and 20 can simultaneously be locked to the active arm 14, in which case the highest lift cam lobe—cam 26 in the embodiment of FIG. 1—will control and the valve follows its input motion. Operation of the locking mechanism is described in more detail below in relation to FIGS. 2 and 3.

A valve train having this rocker configuration is advantageous in terms of the reduced overall height of the valve train mechanism. This architecture also enables shortening the distance between engine valves' line of action and the pivot shaft centerline, thereby reducing the torque on the locking mechanism assembled inside the pivot shaft.

Figure 2:
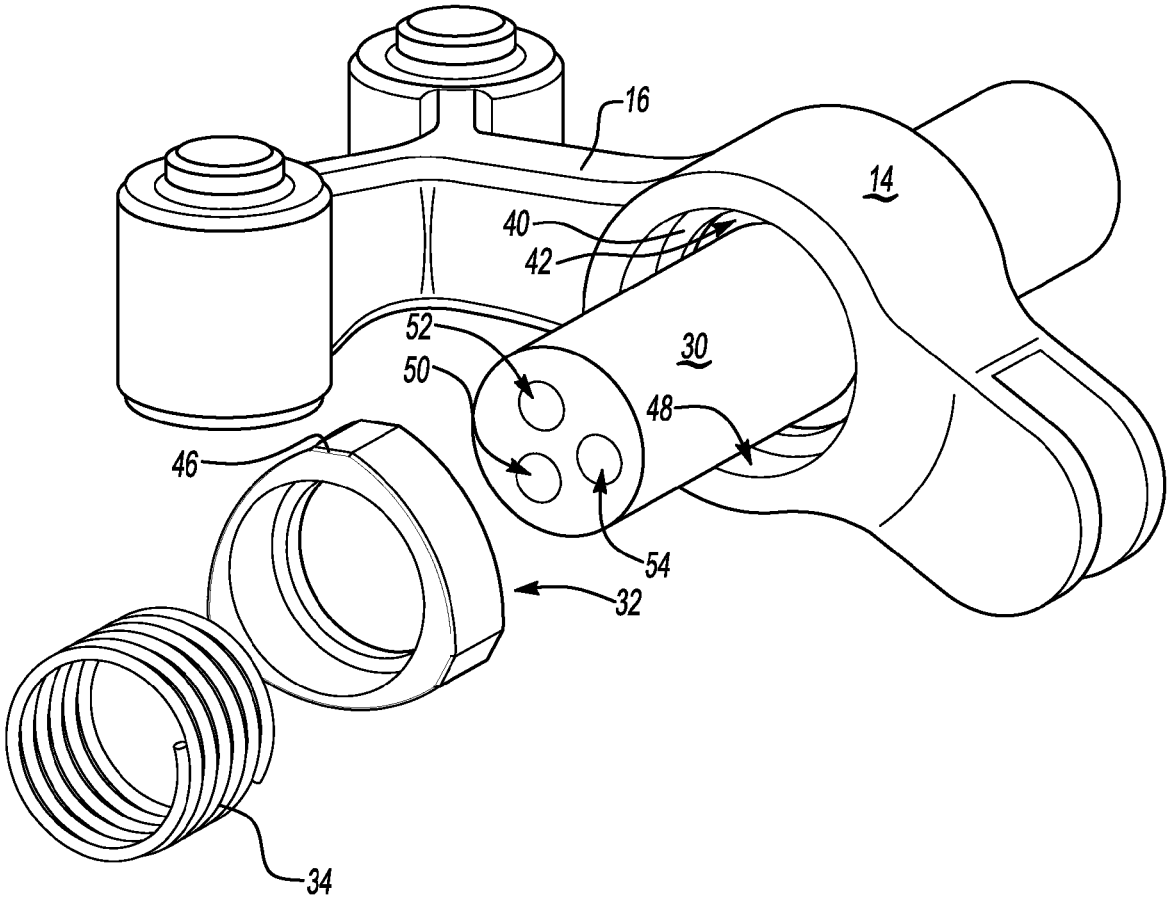
FIG. 2 is an exploded view of a portion of the locking mechanism for a plural rocker arm valve train assembly shown in FIG. 1.
Figure 3:
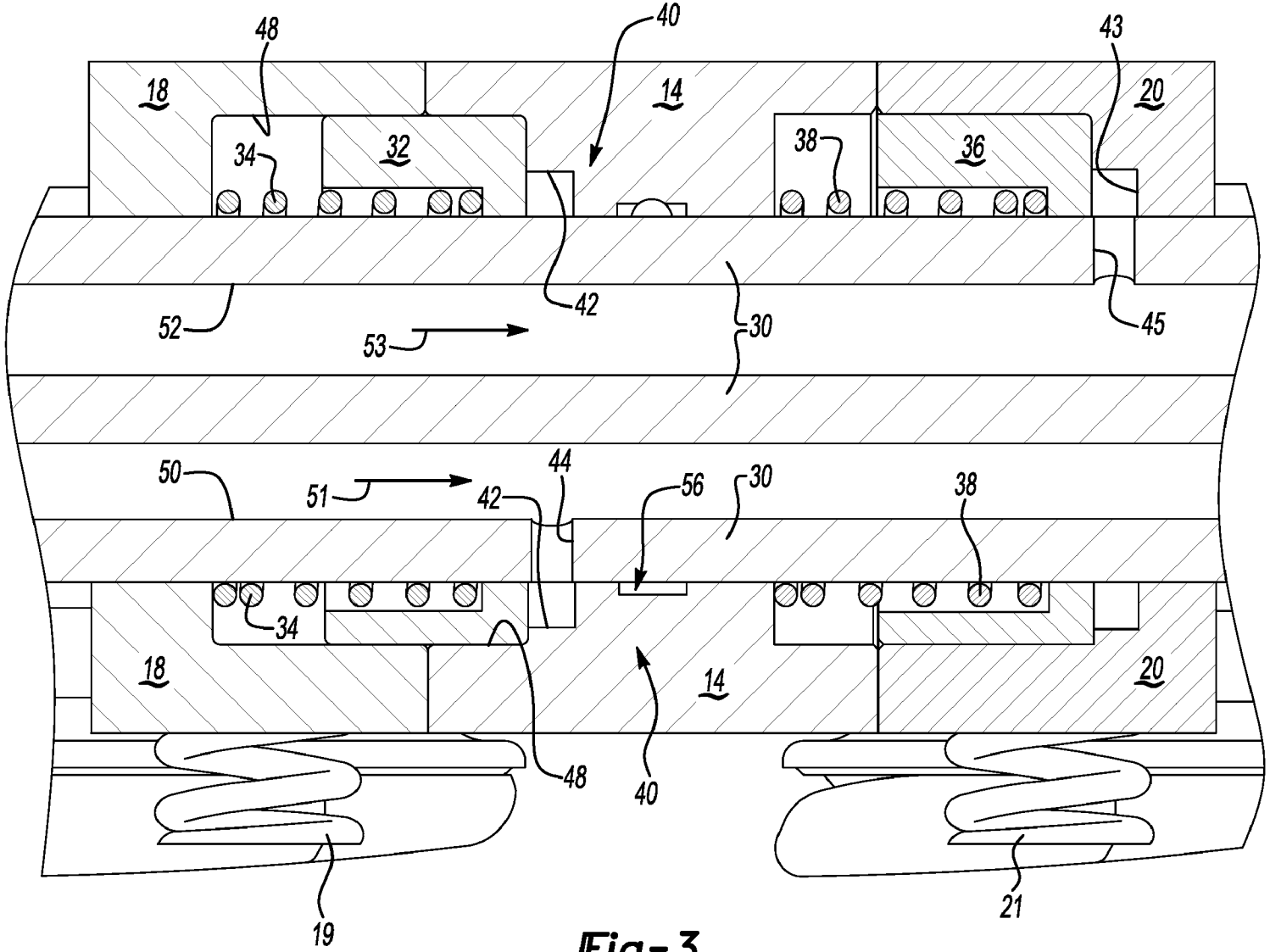
FIG. 3 is cross section view of a portion of a locking mechanism for the plural rocker arm valve train assembly shown in FIG. 1.

Referring now to FIGS. 2 and 3, there are shown portions of the valve train 10 of FIG. 1. FIG. 2 shows an exploded view illustrating components of the internal locking mechanism in greater detail. In addition to the active rocker arm 14 and pivot shaft 30, FIG. 2 shows a first locking element 32 and a first biasing spring 34. FIG. 3 shows a cross section of the pivot shaft 30, the first locking element 32 and a second locking element 36, and the first and second biasing springs 34 and 38. The center pivot portion 40 of the active rocker 14 is shaped like a sleeve, where an oil groove 42 located inside the sleeve registers with a transfer passage 44 inside the pivot shaft 30.

In the embodiment shown in FIGS. 1-3, the locking elements 32 and 36 are polygon-shaped. The polygon-shaped male locking element 32, with a chamfered end 46, is hydraulically actuated to slide along the axis of the pivot shaft 30 and engage into the matching female cavity 48 integral with the sleeve of the center pivot portion 40. This female cavity 48 has a periphery shape complimentary to the polygonal shape of the locking elements 32 and 36, and each of rocker arms 14, 18, and 20 contains a similar female cavity. The polygon-shaped locking elements 32 and 36, shown here as having three lobes, can have other profiles, as long as torque-carrying capacity is maintained and axial engagement is easily achieved. Those skilled in the art will recognize that, within the scope of the claimed invention, other locking element profiles can be used. Other possible locking element profiles include, without limitation: shaft keys, splines, et cetera.

Placement of axially-sliding locking elements inside the rocker arms and around the pivot shaft enables a compact and lighter-weight rocker design. This embodiment also avoids the need for carrying pins, springs, machined holes, and oil-feed galleries located on the outer structures of the rocker arms, which can add mass and complexity to the rocker arms and actuation mechanism.

Referring now to FIGS. 1 and 3, a hydraulic fluid passage 50 runs the axial length of pivot shaft 30 and carries actuation oil to the first locking element 32, which, in this embodiment, is the low lift to lowest lift locking element. A parallel hydraulic fluid passage 52 carries actuation oil to the second locking element 36, which, in this embodiment, is the high lift to low lift locking element. A third passage 54 (not shown in FIG. 3) also runs parallel to the other two passages 50 and 52, and delivers lubrication and lash-adjusting oil to the active rocker 14 and lash adjusters (not shown) via transfer passage 56. These passages 50, 52, and 54 may be in fluid communication with pressure source 49 via fluid conduit 55 or in fluid communication with the engine oil system (not shown), to supply oil or some other hydraulic fluid to the passages 50, 52, and 54 in order to actuate the locking elements 32 and 36. In a preferred embodiment, the engine oil system is used to selectively pressurize hydraulic fluid 51 and 53 to the passages 50 and 52, respectively. The third passage 54 (lubrication channel) communicates with the engine oil circuit. These axial hydraulic fluid passages need not extend throughout the full length of the pivot shaft; other embodiments could include axial passages that end after oil is delivered for rocker actuation or lubrication purposes. Such an embodiment would remove the need for fluid couplings or other hardware for each channel at both ends of the pivot shaft.

Referring to FIG. 3, the valve train 10 is shown in default mode. In this mode, passages 50 and 52 do not contain sufficient pressure in hydraulic fluid 51 and 53 to move locking elements 32 and 36 against their respective biasing springs 34 and 38. Methods for controlling the pressure of hydraulic fluid 51 and 53 are described in greater detail below. In operation, to select alternative locking modes, the pressure of hydraulic fluid 51 or 53, or both, can be increased to overcome the force of biasing springs 34 and 38. In the embodiment shown in FIG. 3, three additional locking modes are available in addition to the default mode shown. In a first alternative locking mode, the pressure of hydraulic fluid 51 is increased to the actuation level. Pressure is communicated from passage 50 through transfer passage 44 and into oil groove 42, and generates sufficient force on locking element 32 to overcome the force of biasing spring 34; causing locking element 32 to move leftward (as viewed in FIG. 3). In this actuated state, locking element 32 no longer locks the active rocker arm 14 to the secondary arm 18, and the two are free to pivot separately. Therefore, the active rocker arm 14 follows the profile of cam lobe 22 and transfers that profile to the valves 11.

In a second alternative locking mode, the pressure of hydraulic fluids 51 and 53 in both passages 50 and 52 is increased to actuation level. The pressure in hydraulic fluid 53 is communicated from passage 52 through a transfer passage 45 and into an oil groove 43, and generates sufficient force on locking element 36 to overcome the force of biasing spring 38; causing locking element 36 to move leftward (as viewed in FIG. 3). In this actuated state, locking element 36 locks the active arm 14 to secondary arm 20, causing the two to pivot commonly. As described above, locking element 32 is in its actuated state, and the secondary arm 18 is disengaged from active rocker arm 14. Therefore, the active rocker arm 14 and secondary arm 20 pivot commonly, and follow the profile of cam lobe 26, transferring that profile to the valves 11. Note that a third alternative locking mode exists, where locking element 32 is not actuated and locking element 36 is actuated. In this third alternative mode, all three rocker arms 14, 18, and 20 are locked together and pivot commonly. This causes the active arm 14 and the valves 11 to follow the profile of which ever cam lobe is the highest, which is cam lobe 26 in the embodiment shown in FIGS. 1 and 3.

In order to regulate the pressure of hydraulic fluid 51 and 53, the actuation-oil channels 50 and 52 communicate with the engine-oil circuit, possibly through a three-position, four-way control valve (not shown) that directs pressurized oil to one channel while connecting the other channel to the sump, which is a low pressure area. In the third position of the control valve, neither channel 50 nor 52 is pressurized; which is the fail-safe default mode. In this default mode, as shown in FIG. 3, the first locking element 32 is engaged making the low lift cam 24 the default lift. If the lowest lift cam profile is not zero (zero being the de-activation state), then in the default mode this first locking element 32 could be designed to stay disengaged by reversing the direction of oil pressure force and the force of biasing spring 34.

In an alternate embodiment, two simpler control valves (not show) can be used; each having a two-position, two-way function, one control valve being associated with each actuation channel. In the de-energized mode, each control valve connects the respective channel to the sump. Energizing one or the other valve will connect the respective actuation channel to the high-pressure oil circuit.

In another embodiment (not shown), a third actuation strategy would eliminate one of the three axial fluid passages 50, 52, or 54. In this strategy, lubrication and one of the two actuations is done using the same feed and axial fluid passage. As long as the lubrication oil pressure in the passage is regulated to stay below a set value, which is likely to be lower than the engine oil pressure level, that locking element will remain in the un-actuated position. To actuate the shared passage, one control valve will switch the feed pressure from that regulated (low) value to the engine oil pressure. The function of the other control valve controlling the other actuation line remains the same as above. The drawback of combining one actuation channel with the lubrication channel is the resulting regulated (lowered) oil pressure for journal lubrication and lash adjusting.

Figure 4:
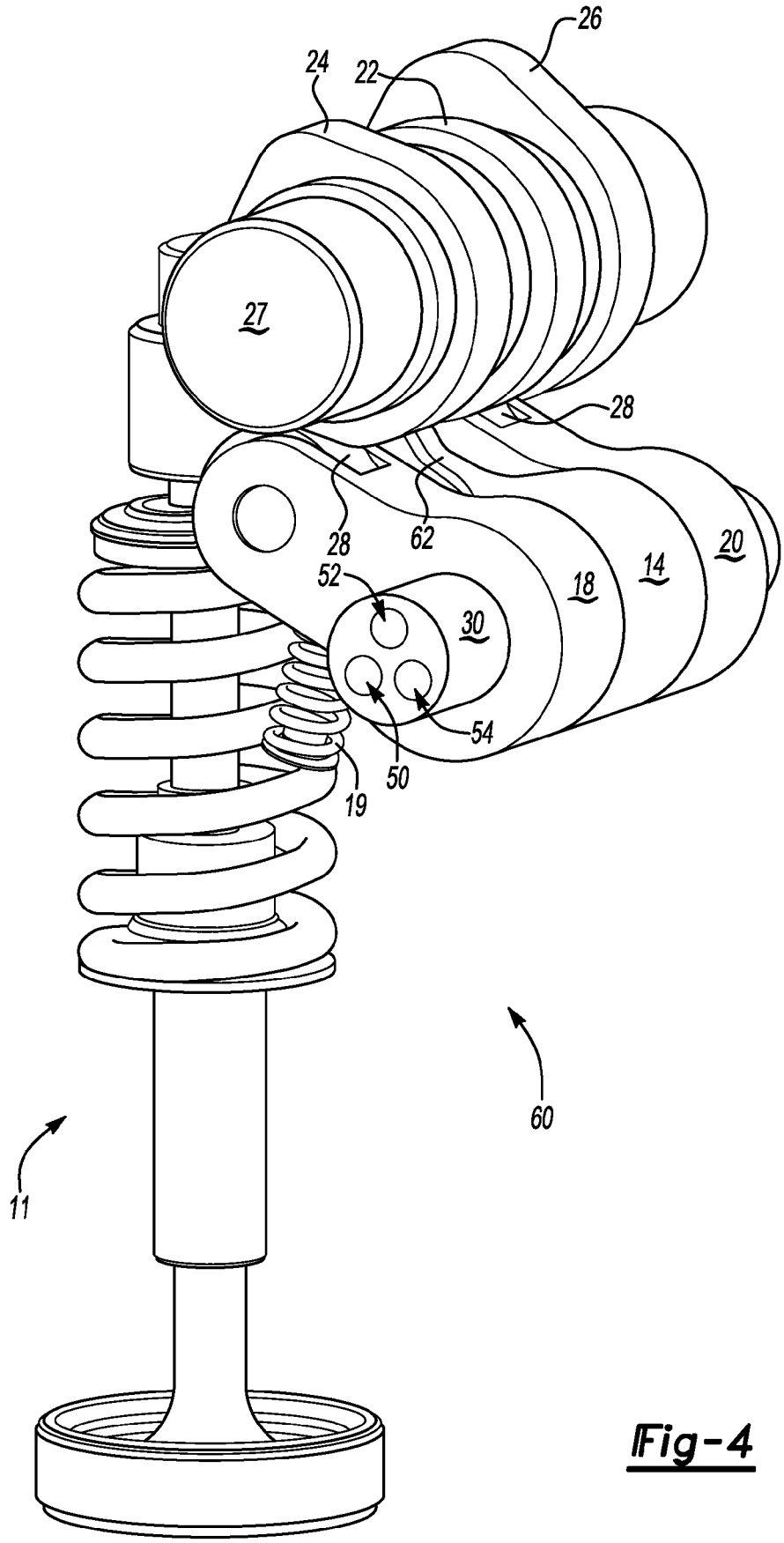
FIG. 4 is a perspective view of an alternate embodiment of a plural rocker arm valve train assembly.

FIG. 4 shows an alternate embodiment of a locking mechanism, an end-pivoted valve train 60 driving a single engine valve 11, and employing a sliding pad 62 at the active rocker arm 14. The active rocker, shown as having a sliding pad 62 contact with its respective cam 22 could also have a roller (like the rollers 28) at the cam end. This roller would lower friction, especially if the lowest valve lift desired is not the zero-lift, deactivation case. The operational characteristics as to the lobe switching, lash adjusting, and oil routing features discussed above for the center-pivoted architecture (FIGS. 1-3) apply to this configuration as well. Locking and actuation strategies are also the same.

In additional embodiments (not shown) a cam may be provided having two symmetric outer lobes. These symmetric outer lobes would provide the high lift profiles, while the remaining inner lobe would be the low lift profile. A single feed line will actuate both locking elements simultaneously. The low lift center lobe is the default mode of operation, corresponding to either low pressure levels or no oil pressure—such as during a failure in the oil pressure system. When the single feed line is pressurized sufficiently to overcome the force of the biasing springs, the locking elements would lock the inner rocker to both of the two outer rockers (corresponding to the symmetric high lift lobes) and place the valve train in the high lift mode. The single feed line to the locking elements can be a separate line from the lubrication line, or can be shared with the lubrication line by using a regulated pressure line, as described above.

While the best modes for carrying out the invention have been described in detail, those familiar with the art to which this invention relates will recognize various alternative designs and embodiments for practicing the invention within the scope of the appended claims.

The invention claimed is:

1. A locking mechanism for a plural rocker arm valve train assembly adapted for use with a camshaft having a plurality of cam lobes having a plurality of cam lobe profiles, comprising:

a pivot shaft parallel to said camshaft and defining a common axis located within said pivot shaft;

a plurality of rocker arms pivotably contacting said pivot shaft, each having structures configured to be acted upon by respective lobes of said camshaft, wherein said plurality of rocker arms are pivotable about said common axis;

wherein one of said plurality of rocker arms is an active rocker arm having a structure configured to act upon an engine valve;

a movable locking element enclosed by said plurality of rocker arms; and said movable locking element being oriented to selectively move along said common axis to allow said active rocker arm to selectively engage one or more other of said plurality of rocker arms for common pivoting therewith, said selective engagement thereby varying displacement of said engine valve.

2. The locking mechanism of claim 1, wherein said active rocker arm contains a female opening centered about said common axis, defining a cavity between said active rocker arm and said pivot shaft, wherein said movable locking element has a periphery shape complementary to said female opening and is pivotably and slidably in contact with said pivot shaft.

3. The locking mechanism of claim 2, wherein said female opening and said movable locking element are polygon shaped.

4. The locking mechanism of claim 2, wherein said movable locking element includes chamfered edges configured to facilitate mating of said movable locking element and said female opening.

5. The locking mechanism of claim 1, further including a hydraulic fluid passage, wherein said hydraulic fluid passage is an axial passage defined within said pivot shaft, and wherein said hydraulic fluid passage is configured to provide fluid communication with said movable locking element.

6. The locking mechanism of claim 5, further including a pressure source, wherein said pressure source is in fluid communication with said hydraulic fluid passage.

7. The locking mechanism of claim 6, wherein pressure from said pressure source is configured to actuate said movable locking element.

8. The locking mechanism of claim 5, wherein said hydraulic fluid passage is configured to provide lubricating oil to the locking mechanism.

9. The locking mechanism of claim 1, wherein said camshaft has at least three different cam lobe profiles, thereby allowing three different displacements of said engine valve.

10. A locking mechanism for a plural rocker arm valve train assembly adapted for use with a camshaft having a plurality of cam lobes having a plurality of cam lobe profiles, comprising:

a pivot shaft parallel to said camshaft and defining a common axis, wherein said common axis is located within said pivot shaft;

a first rocker arm pivotably contacting said pivot shaft and pivotable about said common axis, having structures configured to be acted upon by a first lobe of said camshaft;

wherein said first rocker arm has structures configured to act upon an engine valve;

a second rocker arm pivotably contacting said pivot shaft and pivotable about said common axis, having structures configured to be acted upon by a second lobe of said camshaft;

a third rocker arm pivotably contacting said pivot shaft and pivotable about said common axis, having structures configured to be acted upon by a third lobe of said camshaft;

a movable locking element enclosed by said first, second, and third rocker arms; and said movable locking element being oriented to selectively move along said common axis to allow said first rocker arm to selectively engage one of said second rocker arm and said third rocker arm for common pivoting therewith, said selective engagement thereby varying displacement of said engine valve.

11. The locking mechanism of claim 10, further including hydraulic fluid, wherein said movable locking element is actuated by said hydraulic fluid.

12. The locking mechanism of claim 10, wherein said first rocker arm contains a female opening centered about said common axis, defining a cavity between said first rocker arm and said pivot shaft, wherein said movable locking element has a periphery shape complementary to said female opening and is pivotably and slidably in contact with said pivot shaft, and wherein at least one of said second rocker arm and said third rocker arm contains an adjacent complementary female opening.

13. The locking mechanism of claim 10, wherein said camshaft has at least three different cam lobe profiles, thereby allowing three different displacements of said engine valve.

14. A locking mechanism for a plural rocker arm valve train assembly adapted for use with a camshaft having a plurality of different cam lobes having a plurality of different cam lobe profiles, comprising:

a pivot shaft parallel to said camshaft and defining a common axis, wherein said common axis is located within said pivot shaft;

a first rocker arm pivotably contacting said pivot shaft and pivotable about said common axis, having structures configured to be acted upon by a first lobe of said camshaft;

wherein said first rocker arm has structures configured to act upon an engine valve;

a second rocker arm pivotably contacting said pivot shaft and pivotable about said common axis, having structures configured to be acted upon by a second lobe of said camshaft;

a third rocker arm pivotably contacting said pivot shaft and pivotable about said common axis, having structures configured to be acted upon by a third lobe of said camshaft;

a movable locking element enclosed by said first, second, and third rocker arms;

hydraulic fluid located within a hydraulic fluid passage, wherein said hydraulic fluid passage is an axial passage defined within said pivot shaft;

said movable locking element being oriented to selectively move along said common axis to allow said first rocker arm to selectively engage one of said second rocker arm and said third rocker arm for common pivoting therewith, said selective engagement thereby varying displacement of said engine valve; and wherein said movable locking element is actuated by said hydraulic fluid.

15. The locking mechanism of claim 14, wherein said hydraulic fluid passage is further configured to provide lubricating and lash adjusting oil to the locking mechanism.

16. The locking mechanism of claim 14, wherein said first rocker arm contains a female opening centered about said common axis, defining a cavity between said first rocker arm and said pivot shaft, wherein said movable locking element has a periphery shape complementary to said female opening and is pivotably and slidably in contact with said pivot shaft, and wherein at least one of said second rocker arm and said third rocker arm contains an adjacent complementary female opening.

17. The locking mechanism of claim 14, wherein said camshaft has at least three different cam lobe profiles, thereby allowing three different displacements of said engine valve.

18. The locking mechanism of claim 14, further comprising a locking element biasing spring, wherein said movable locking element is actuated against the force of said locking element biasing spring.

19. The locking mechanism of claim 14, further comprising a rocker arm biasing spring configured to provide a force opposing the pivoting of said second rocker arm.

* * * * *